United States Patent [19]

Flanagan

[11] Patent Number: 4,659,248

[45] Date of Patent: Apr. 21, 1987

[54] SELF CLEANING PAVEMENT MARKER

[75] Inventor: Robert M. Flanagan, Lincolnshire, Ill.

[73] Assignee: Amerace Corporation, Hackettstown, N.J.

[21] Appl. No.: 833,634

[22] Filed: Feb. 18, 1986

Related U.S. Application Data

[63] Continuation of Ser. No. 322,253, Nov. 17, 1981, abandoned.

[51] Int. Cl.[4] ..... E01F 9/06

[52] U.S. Cl. ..... 404/10; 404/16; 350/102

[58] Field of Search ..... 404/10-12, 404/15, 16; 350/97, 102

[56] References Cited

U.S. PATENT DOCUMENTS

| | | | |
|---|---|---|---|
| 1,981,206 | 11/1934 | Strauss | 404/16 X |
| 2,703,038 | 3/1955 | Shaw | 404/16 |
| 2,941,447 | 6/1960 | Abbott, Sr. | 350/97 X |
| 3,093,038 | 6/1963 | McRobbie et al. | 404/16 |
| 3,216,335 | 11/1965 | Stolarczyk et al. | 404/11 |
| 3,292,506 | 12/1966 | Kone | 404/11 |
| 3,332,327 | 7/1967 | Heenan | 404/16 |
| 3,373,667 | 3/1968 | Taylor-Myers | 404/12 |
| 3,377,930 | 4/1968 | Kone | 404/11 |
| 3,809,487 | 5/1974 | Flanagan | 404/15 |
| 3,980,393 | 9/1976 | Heasley et al. | 350/97 X |
| 4,049,358 | 9/1977 | King et al. | 350/102 X |
| 4,130,370 | 12/1978 | Kone | 404/11 |
| 4,147,447 | 4/1979 | Heenan et al. | 404/16 |
| 4,284,365 | 8/1981 | Rabinow | 350/97 X |

FOREIGN PATENT DOCUMENTS

| | | |
|---|---|---|
| 614657 | 12/1948 | United Kingdom . |
| 648542 | 1/1951 | United Kingdom . |

*Primary Examiner*—Stephen J. Novosad
*Assistant Examiner*—John F. Letchford
*Attorney, Agent, or Firm*—David Teschner; Ronald A. Sandler

[57] ABSTRACT

A self-cleaning pavement marker adapted to be installed in a groove below the plane of the driving surface of an associated roadway to provide a retroreflective light signal visible to an oncoming vehicle. The marker comprises an integrally formed elastomeric body adapted to be positioned in a longitudinally extending groove cut in the roadway surface. The body includes an upper portion for receiving a retroreflective lens means. The lens means is effective a retroreflect light impinging upon its front face from an oncoming vehicle back toward the vehicle. The upper body portion of the marker is depressible between a normal position wherein the lens means is positioned below the plane of the associated roadway to retroreflect light impinging on the front face from an oncoming vehicle back toward the light source, and a depressed position caused by the force of a vehicle tire passing over the upper body portion. Wiping means is positioned below the plane of the associated roadway and is integrally formed with the body, and is positioned adjacent to the front face of the lens means, and is configured and arranged such that the wiping means does not interfere with the retroreflective function of the lens means when the body portion is in the normal position. Upon depression of the upper body portion to the depressed position, and its return to the normal reflecting position, the front face of the lens means moves past the wiping means and in direct contact therewith, whereby the wiping means effects a debris-cleaning and wiping function. The marker is effective as a snowplowable marker, particularly where studded tires are permitted.

17 Claims, 4 Drawing Figures

SELF CLEANING PAVEMENT MARKER

This is a continuation of application Ser. No. 322,253, filed on Nov. 17, 1981 now abd.

FIELD OF THE INVENTION

This invention relates generally to retroreflective pavement markers and, more particularly, to depressible pavement markers which are self-cleaning and snowplowable.

BACKGROUND OF THE INVENTION

Retroreflective pavement markers are used to provide a reflected signal for marking traffic lanes and for edge delineation at night and particularly under adverse weather conditions. The term "retroreflector", as used herein, refers generally to reflectors adapted to reflect light emanating from an oncoming vehicle back toward the vehicle. Various types of retroreflective elements are known, and may include cube-corner type reflectors, lens-mirror devices, beaded sheet, cube-corner type sheeting, and other retroreflective devices.

Pavement markers may be classified generally as either of a "moving" or "depressible" type (typical examples of such markers being disclosed in U.S. Pat. Nos. 2,941,447; 3,093,038; 3,216,335; 3,373,667; and 4,130,370; and British Pat. Nos. 648,542 and 614,657) or of a non-moving, self-cleaning type (such as disclosed in Heenan U.S. Pat. No. 3,332,327, assigned to applicant's assignee). Copies of all the foregoing patents accompanied the filing of the parent to this application.

Prior art pavement markers, particularly the depressible type referred to hereinabove, generally have involved moving parts and expensive castings in an attempt to make them both depressible and self-wiping, and all have encompassed several parts to achieve that function. As an example, they may require springs or other component parts set in separate castings and provided with a depressible portion, or they may involve a rubber-type surface also set in a metal casting of some character. Those prior art depressible type markers are expensive to produce and install. Additionally, in many instances, those prior art markers are not capable of sustaining repeated impact of studded tires on the reflective elements. Also, partly extending above the roadway surface, they are subject to severe damage by snow-plow blades.

The rigid or non-moving self-cleaning type markers, such as found in Heenan U.S. Pat. No. 3,332,327, and the snowplowable versions of that marker, also disposed in metal castings and positioned slightly above the roadway surface, provide an extremely effective marking system. However, when used with a metal casting, they also are relatively costly to produce and install as compared to the nonsnowable use which does not require the metal casting. Also, the angled front face of those type of markers, intended to be wiped by the tires of oncoming vehicles to keep them clean, exposes the front surface to damaging impact by tire studs, and therefore they are not used in those areas where studded tires are regularly used.

In the past several years there has been experimentation by several states in snow-plow areas, in placing existing markers, such as those disclosed in the aforesaid '327 patent, in elongated grooves cut in the roadway surface. One expected advantage of this groove-marker system is the elimination of the metal casting used in snow-plow areas, and also this results in recessing the marker below the roadway surface to avoid impact by snow plow blades. But even when recessed in grooves, those markers are still subject to damage by studded tires and, being recessed, they may not be wiped as effectively as units directly on the roadway surface.

Accordingly, a primary object of the present invention is to provide an inexpensive simple, self-cleaning, easy to install depressible-type pavement marker which can be used on roadways serviced by snowplows.

It is a further object of the present invention is to provide a pavement marker of the type described which is depressible when contacted by the tire of a vehicle passing thereover, so that the tire causes the marker to effect a wiping and cleaning action during said movement, whereby the marker can retain a relatively high percentage of its reflective capabilities over an extended period. In this regard, it is anticipated that the deterioration of reflectivity will be less for the depressible marker of the present invention than for immovable type markers subject to the direct abrasive action of tires.

It is a further object of the invention to provide a depressible and self-cleaning pavement marker of the type described which further includes means for protecting the retroreflector lens means from damage from the sharp pointed edges of studs typically employed on winter snow tires.

It is a further object of the invention to provide, in a pavement marker of the character described, a body member integrally formed of an elastomeric material which is depressible and will resiliently return to a non-depressed reflective position, and which further includes wiping means integrally formed therewith and retroreflective lens means carried by a portion of the body member, and which requires no additional housing or casting for placement on the associated roadway.

SUMMARY OF THE INVENTION

The invention, in its preferred embodiment, comprises a selfcleaning pavement marker adapted to be installed in an elongated groove provided in the associated roadway surface, in a fashion such that the marker normally is disposed substantially entirely below the plane of the driving surface of the associated roadway. The elastomeric body includes an upper body portion for receiving a retroreflective lens means, the retroreflective lens means being secured to the upper body portion and includes a front face and retroreflective system effective to retroreflect light impinging on the front face from an oncoming vehicle back toward the vehicle. The upper body portion is positionable between a normal, non-depressed reflecting position, wherein the lens means is positioned to retroreflect light toward the light source, while still being positioned below the roadway surface, and a depressed position caused by the force of a vehicle tire passing thereover. Wiping means, also located below the plane of the associated roadway, is positioned adjacent to the front face of the lens means, to effect a wiping action upon the front face as the lens means is moved between the normal reflecting position, and the depressed position. The wiping means effects a debris-cleaning and wiping function on the front face so as to retain a high percentage of the reflector's brightness over an extended time period. In the preferred embodiment, the elastomeric member including the body potion and wiping means is a single, integrally formed extruded member og a gewnerally G-shaped configuration. It is easily positionable and affixed to the groove cut in the underlying roadway surface. The retroreflector lens means includes a lens holder to which the retroreflective is secured, a metal cap for protecting the lens and lens holder from studded snow tires which pass thereover, and a lens having retroreflective system therein. The lens holder is a generally T-shaped member having a leg portion which is adapted to be secured within a receiving slot in the upper body portion and a cross member to which the retroreflective lens is secured, whereby depression of the upper body portion by the force of the vehicle tire passing thereover moves the retroreflective lens means relative to the wiping means to clean debris therefrom. In this preferred form, an abrasion resistant material, such as glass, is applied to the front face of the lens means.

The invention, both as to its organization and method of operation, together with other objects and advantages thereof, will best be understood with reference to the following specification, taken in combination with the accompanying drawings.

DETAILED DESCRIPTION OF THE DRAWINGS

Figure 1:
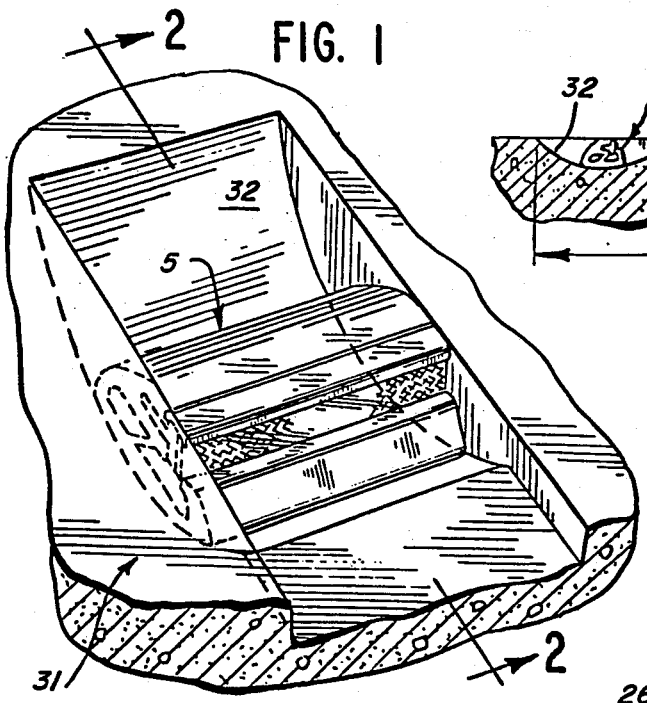
FIG. 1 is a perspective view of the pavement marker of the present invention, positioned in a groove formed in an associated roadway surface.

Referring now to the drawings, and more particularly to FIG. 1, one specific embodiment of pavement marker encompassing the principles of the present invention is illustrated generally by the numeral 5. The pavement marker 5 illustrated in FIG. 1 is adhesively secured in a portion of a groove 30 formed beneath the plane P of the driving surface of the associated roadway 31. The pavement marker 5 is simple in construction and comprises a depressible body 10 and a reflective lens assembly 20.

Figure 2:
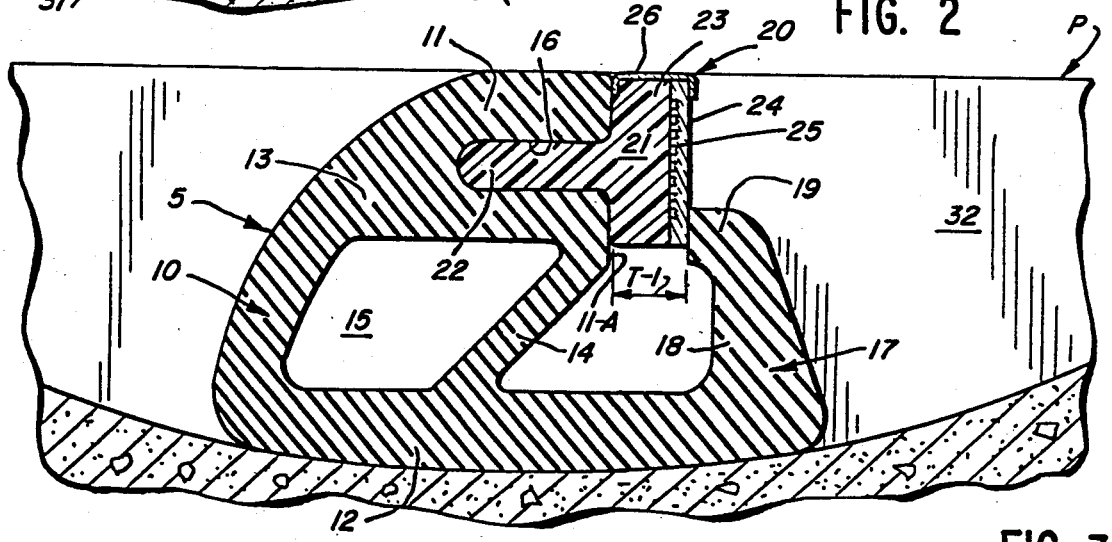
FIG. 2 is a cross-sectional view taken along line 2—2 of FIG. 1, and illustrating the pavement marker of the present invention disposed within a groove in the pavement surface, in its normal reflective position.

As best seen in FIG. 2, the depressible marker body 10 of the pavement marker 5 is generally G-shaped in cross-sectional configuration and is preferably formed of an integral member extruded from neoprene or an equivalent elastomer. The marker body 10 includes a thickened, generally flat upper body portion 11, a base portion 12, and a curved central body portion 13 interconnecting the upper body portion 11 and the base portion 12. The lower or base portion 12 is partially flattened and elongated to maximize the surface area of contact between the marker 10 and a pocket 32 of groove 30 formed in the road surface 31. A stiffening web 14 interconnects the upper body portion 11 and the base portion 12, so as to form, in the central section of the G-shaped body 10, a transversely extending, open-ended bore 10.

A transversely extending slot 16 is formed in the thickened upper body portion 11 to receive and secure therein a retroreflector lens means assembly designated generally as 20. Although not illustrated, the inner end of the slot 16 may be enlarged so as to more effectively retain a correspondingly shaped portion of the lens means assembly 20.

The end of the lower base portion 12 opposite the central body portion 13 (and forming the other upright leg of the G) which provides the wiping means 17, includes an integrally formed and vertically disposed arm 18 which terminates in an inwardly extending reverse tip or wiper blade 19, the operation of which will be explained in detail hereinafter. The precise shape of the body 10 may be altered without departing from the spirit or scope of the invention, as long as the configuration of the pocket 32 in the roadway groove 30 to which the lower base portion 12 is bonded, is corresponding shaped so that a relatively large contact surface in which to bond the marker 5 to the groove 30 is provided.

The retroreflector lens means 20 comprises a lens holder 21, a retroreflective lens 24 having a retroreflector system 25, and a protective metal cap 26. The lens holder 21 is generally T-shaped in cross-sectional configuration and is preferably molded from a high impact and abrasion-resistant plastic, such as polycarbonate. The lens holder 21 includes a leg member 22 adapted to be received within the transverse lot 16 of the upper body portion 11 of the marker body 10, and a cross-member 23 adapted to have the lens 24 secured thereto. The leg 22 preferably is slightly thicker than the slot 16 so as to provide a tight friction fit therewith. The length of the cross-member 23 is approximately equal to the thickness of the upper body portion 11, so that no portion of the cross member 23 extends beyond the upper body portion 11.

The thickness T-1 (see FIG. 2) of the cross member 23, with the lens 24 secured thereto, is slightly greater than the distance between the reverse tip or blade 19 of the wiping arm 18 and the free end 11A of the upper body portion 11, so that, with the lens means 20 secured to the upper body portion 11, the blade 19 will be normally biased against the lower edge of the lens 24. A metal cap 26 covers and is adhesively bonded to the top portion of the lens holder cross-member 23 and the lens 24 to protect the lens assembly 20 from damage by studs of snow tires passing thereover.

The lens 24 may be ultrasonically welded or otherwise secured to the cross-member 23 so as to provide a strong, sealed bond therebetween. The front face of the lens 24 preferably is provided with an abrasion resistant material (not shown) so as to minimize scratching and abrasion caused by salt and sand and other delecterious materials on the roadway surface in contact with the front face.

In a preferred embodiment, the reflective lens 24 may consist of a synthetic resin lens having cube-corner type reflecting elements formed on the rear face to form the reflective system designated generally at 25. Cube corner type reflecting elements (also often referred to synonomously as triple mirror or triple reflectors) are well known and consist of three mutually perpendicular reflective faces for retroreflecting light. The lens itself preferably is provided with an untempered micro-sheet glass (not shown) to protect the lens front face from abrasion. The glass may be bonded to the lens 24 using an ultraviolet sensitive urethane base adhesive which is cured. This is taught for example in U.S. Pat. No. 4,232,979, assigned to applicant's assignee and incorporated herein by reference. The lens 24 may be fabricated in any one of a number of well known ways, including the following, depending upon cost and other considerations: (1) securing retroreflective sheeting (either glass bead or cube corner type) between the lens holder cross-member 23 and the lens 24; (2) molding a lens of retroreflective cube corner type elements and providing an air-gap between the lens elements and the lens holder cross-member; (3) using a "filled" lens member having a reflective system therein.

The use of retroreflective sheeting between the lens holder member 23 and the associated micro-sheet glass is the least expensive, but also probably is least able to absorb impact forces. Other designs may better be able to withstand impact forces, but may be more costly to produce. In lieu of a glass overlay, a hard coating such as a silicate can be sprayed or brushed over the front face of the lens 24 to provide an inexpensive but abrasion-resistant material. Other types of retroreflective systems may be used with the body 10.

Figure 4:
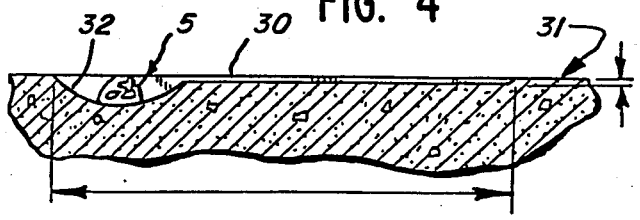
FIG. 4 is a cross-sectional view of the roadway illustrating a marker of the present invention positioned in a groove provided therefor.

In preparing the road for installation of the depressible road marker 5 of the present invention, a bump cutter is moved along the section of roadway wherein the marker is to be placed. The cutter forms a ⅜ inch deep by 3 inch wide groove for a distance of approximately 48 inches. At the end of 48 inches, at the location where the marker 5 is to be installed, forward motion of the cutter is halted, and the cutting head thereof is burrowed to form a "pocket" such as at 32 (FIG. 4), to a depth of about 1.3 inches, the height of the marker depicted herein. The generally flat lower base portion 12 of the body 10 of the marker 5 is then bonded to the bottom surface of the groove 30 with a flexible waterproof adhesive.

The overall vertical height of the pavement marker 5 in a non-depressed position and measured from the lower base portion 12 to the top surface of the upper body portion 11 cannot exceed about 1.3 inches (the depth of the pocket 32 where the marker 5 is located). In other words, the height of the body 10 should be about equal to or less than the depth of the pocket 32 in groove 31 beneath the pavement surface, whereby no part of the body 10 or lens 24 extends above the driving plane P of the roadway surface. Therefore, snowplow blades which move along or slightly above the pavement surface will not impact against or cauase damage to the pavement marker 5. The wiper blade preferably is about 0.189 inches in height and the top surface of it is about 0.87 inches above the lower surface of base portion 12. The bottom of the exposed reflective portion of the front face of the lens 24 is about 0.46 inches below the top of the roadway surface. The body 10 preferably is extruded of neoprene having a hardness in the range of 50–60 durometer, Shore A.

The dimensions of the groove 31 after cutting are about ⅜ inches deep (1.3 at the marker location), 3 inches wide, and 48 inches long, and are necessary to the successful operation of the below-the-surface pavement marker of the invention. Using those dimensions and assuming a total reflector specific intensity of 3.0, the specific intensity of the reflective lens at a distance of 500 feet would be approximately 10, with the signal increasing in intensity as the vehicle approaches the marker 5. When the distance between the vehicle and the marker is reduced to about 250 feet, the entire marker front face can be observed by the driver of the approaching vehicle.

In instances wherein bidirectional signals are necessary, such as when the pavement markers are to be disposed at the center line of a two-lane road, two self-cleaning, depressible markers 5 may be installed in back-to-back relation with the groove 31 extending about 48 inches from each marker, or one marker may be installed in a pocket formed at each end of a 48 inch groove.

The body 10 of the pavement marker 5 is normally disposed in a non-depressed or normal, reflective position wherein the top surface of the upper body portion 11 is at or below the plane P of the roadway surface.

Figure 3:
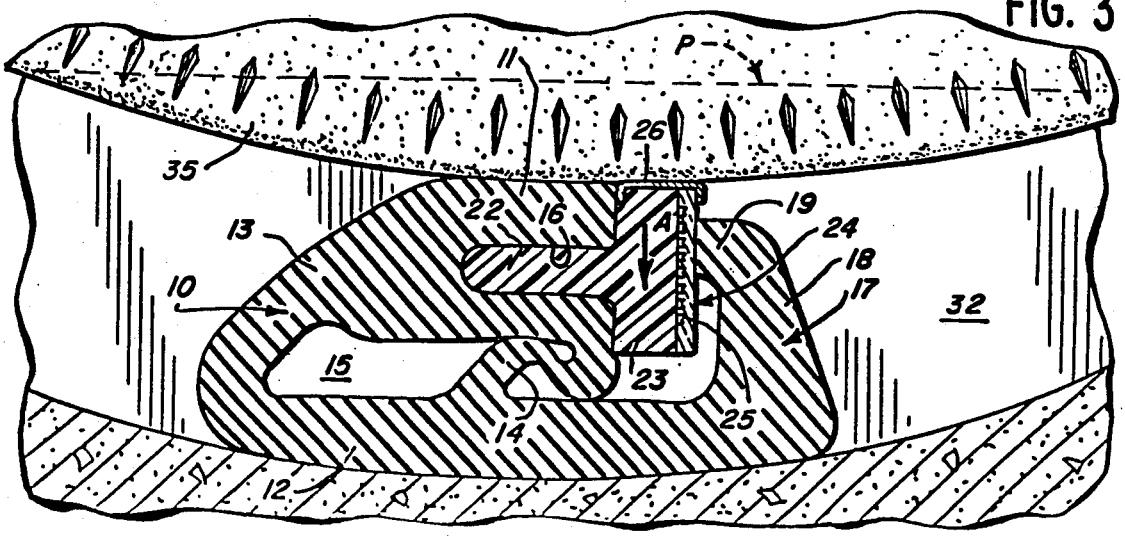
FIG. 3 is a cross-sectional view similar to FIG. 2, illustrating the pavement mark in its depressed position due to the application of downward force by a vehicle tire passing thereover.

The self-cleaning feature of the invention is initiated when a vehicle tire, such as 35 in FIG. 3, rolls over the marker body 10, thereby moving the upper body portion 11 and stiffening web 14 downwardly in the direction of arrow "A" from the normal, non-depressed reflective position of FIG. 2, to the depressed position of FIG. 3. As the upper body portion 11 moves in the direction of arrow A, the lens 24 moves downwardly relative to the wiper blade 19 biased thereagainst, so as to clean debris and dirt from the front face of the lens 24. During the depression cycle, the web 14, being the weakest part of the body 10, is folded to permit the body 10 to compress, and air and water are exhausted from the transverse through bore 15. A 3 inch wide groove is used because it allows a vehicle tire to compress the marker to approximately ⅜ inch, and yet it prevents the entire weight of the vehicle from being transferred onto the marker. The marker body preferably also is about 3 inches wide to prevent sidewise movement in the groove. The vertical distance between the upper surface of the lower body portion 12 and the lower surface of the upper body portion 11 is approximately ⅜ inches to allow for compressibility. After the tire has passed over the marker 10, the elastomeric resilient body 10 springs back to the normal non-depressed reflective position, effecting a further wiping action.

While one form of the preferred embodiment of the invention has been described, it will be understood that various modification may be made therein, and it is intended to cover in the appended claims all such modifications as fall within the true spirit and scope of the invention.

What is claimed is:

1. A self-cleaning pavement marker for use on the driving surface of a roadway, said marker providing a retroreflective signal visible from an oncoming vehicle traveling on said roadway, comprising, in combination:

a groove formed in said driving surface;

a resilient elastomeric marker body having no rigid or nonelastomeric portions;

said marker body being sized and shaped to fit within and be secured in said groove such that said marker body is generally at no time positioned above the plane defined by said driving surface;

retroreflective lens means secured to an upper portion of said marker body;

said lens means including a front face and a rear face, said rear face having a cube-corner type retroreflective lens system thereon;

said lens means being adapted to retroreflect light impinging on said front face from an oncoming vehicle back toward said vehicle;

said front face of said lens means being overlaid with a material more abrasion-resistant than that material forming said retroreflective lens system;

said upper body portion being movable between a normal reflective position wherein said lens means is positioned below the plane of said driving surface to retroreflect light impinging on said front face from an oncoming vehicle back toward said vehicle, and a depressed position caused by the force of a vehicle tire passing over said upper body portion; and wiping means positioned below the plane of said driving surface and adjacent to said front face, said wiping means being configured and arranged such that said wiping means does not interfere with the retroreflective function of said lens means when said upper body portion is in said normal position but upon movement of said upper body portion to said depressed position and return to said normal position said front face of said lens means moves past said wiping means and in direct contact therewith whereby said wiping means effects a debris-cleaning and wiping function on said front face.

2. The pavement marker set forth in claim 1, wherein said wiping means is integrally formed as a part of said marker body.

3. The pavement marker set forth in claim 1 wherein said upper body portion includes a transversely extending slot for receiving a complementary-shaped portion of said lens means therein.

4. The pavement marker set forth in claim 1, wherein said body is elastomeric and is generally G-shaped in cross-sectional configuration, said retroreflective lens means being secured in the upper body portion of said G-shaped body and said wiping means comprising an inwardly extending blade formed on the return portion of said G-shaped body.

5. The marker set forth in claim 4, wherein said body includes an integrally formed stiffening web extending transversely from said upper body portion downwardly to intersect the lower curved portion of said G-shaped body, thereby to provide a support and positioning member for said body in both the compressed and normal positions of said body, and said web defining an air pocket permitting expulsion of air upon depression of said upper body portion.

6. The pavement marker set forth in claim 4, wherein said elastomeric body is neoprene and has a hardness in the range of 50 to 60 durometers, Shore A.

7. A self-cleaning pavement marker adapted to be installed substantially entirely below the plane of the driving surface of an associated roadway while providing retroreflective signal visible from an oncoming vehicle, the marker comprising:

a resilient elastomeric body adapted to be positioned in an associated groove provided directly in the roadway surface;

retroreflective lens means secured to an upper portion of said body and including a front face and a cube-corner type retroreflective lens system on the rear face thereof, said lens means being adapted to retroreflect light impinging on said front face from an oncoming vehicle back toward said vehicle;

said front face of said lens means being overlaid with a material more abrasion resistant than that material forming the cube-corner type reflective elements;

said upper body portion being movable between a normal reflective position wherein said lens means is positioned below the plane of the associated roadway to retroreflect light impinging on said front face from an oncoming vehicle back toward said vehicle and a depressed position caused by the force of a vehicle tire passing over said upper body portion wherein said upper body portion includes a transversely extending slot for receiving a complementary shaped portion of said lens means therein;

wiping means positioned below the plane of the associated roadway and adjacent to said front face and being configured and arranged such that said wiping means does not interfere with the retroreflective function of said lens means when said upper body portion is in the normal position but upon movement of said upper body portion to the depressed position and return to said normal position said front face of said lens means moves past said wiping means and in direct contact therewith whereby said wiping means effects a debris-cleaning and wiping function on said front face;

said retroreflective lens means includes a generally T-shaped lens holder, said holder having a leg portion adapted to be secured within said transversely extending slot, and a cross member portion carrying said retroreflective lens means for reflecting the light impinging thereon.

8. The pavement marker set forth in claim 7, and further including a transversely extending cap overlying a portion of the upper surface of said cross member and said retroreflective lens, to protect said lens from damage from tires impacting upon said pavement marker.

9. A self-cleaning pavement marker adapted to be installed substantially entirely below the plane of the driving surface of an associated roadway while providing a retroreflective signal visible from an oncoming vehicle, the marker comprising:

an elastomeric body adapted to be positioned in an associated groove provided directly in the roadway surface;

said body being generally G-shaped in cross-sectional configuration and having an upper body portion, a base portion and wiping means comprising an inwardly extending wiper blade formed on a return portion of said G-shaped body;

and an integrally formed stiffening web extending transversely from said upper body portion downwardly to intersect the lower curved portion of said G-shaped body thereby to provide a support and positioning member for said body and defining an air pocket permitting expulsion of air upon depression of said upper body portion;

retroreflective lens means secured to an upper portion of said body and including a front face and a retroreflective lens system, said lens means being adapted to retroreflect light impinging on said front face from an oncoming vehicle back toward said vehicle;

said upper body portion being movable between a normal reflective position wherein said lens means is positioned below the plane of the associated roadway to retroreflect light impinging on said front face from an oncoming vehicle back toward said vehicle and a depressed position caused by the force of a vehicle tire passing over said upper body portion; and said wiper blade being positioned below the plane of the associated roadway and adjacent to said front face and being configured and arranged such that said blade does not interfere with the retroreflective function of said lens means when said upper body portion is in the normal position but upon movement of said upper body portion to the depressed position and return to said normal position said front face of said lens means moves past said wiper blade and in direct contact therewith whereby said wiper blade effects a debris-cleaning and wiping function on said front face.

10. The pavement marker set forth in claim 9, wherein said upper body portion includes a transversely extending slot for receiving a complementary shaped portion of said lens means therein.

11. The pavement market set forth in claim 10, wherein said retroreflective lens means includes a generally T-shaped lens holder, said holder having a leg portion adapted to be secured within said transversely extending slot, and a cross member portion carrying said retroreflective lens means for reflecting the light impinging thereon.

12. The pavement marker set forth in claim 11, and further including a transversely extending cap overlying a portion of the upper surface of said retroreflective lens means, to protect said lens means from damage from tires impacting upon said pavement marker.

13. The pavement market set forth in claim 9, wherein said front face of said lens means comprises a material more abrasion resistant than the material forming the balance of said retroreflective lens means.

14. The pavement market set forth in claim 9, wherein said elastomeric body is neoprene and has a hardness in the range of 50 to 60 durometers, Shore A.

15. A self-cleaning pavement marker adapted to be installed substantially entirely below the plane of the driving surface of an associated roadway while providing a retroreflective signal visible from an oncoming vehicle, the marker comprising:

a resilient elastomeric body, generally G-shaped in cross-sectional configuration, and adapted to be positioned in an associated groove provided directly in the roadway surface;

a retroreflective lens means secured in the upper body portion of said G-shaped body and including a front face and a cube-corner type retroreflective lens system on the rear face thereof, said lens means being adapted to retroreflect light impinging on said front face from an oncoming vehicle back toward said vehicle;

said front face of said lens means being overlaid with a material more abrasion resistant than that material forming the cube-corner type reflective elements;

said upper body portion being moveable between a normal reflective position wherein said lens means is positioned below the plane of the associated roadway to retroreflect light impinging on said front face from an oncoming vehicle back toward said vehicle and a depressed position caused by the force of a vehicle tire passing over said upper body portion; and wiping means positioned below the plane of the associated roadway and adjacent to said front face and being configured and arranged such that said wiping means does not interfere with the retroreflective function of said lens means when said upper body portion is in the normal reflective position, but upon movement of said upper body portion to the depressed position and return to said normal position, said front face of said lens means moves past said wiping means and in direct contact therewith whereby said wiping means effects a debris-cleaning and wiping function on said front face, said wiping means including an inwardly extending blade formed on the return portion of said G-shaped body.

16. The marker set forth in claim 15, wherein said body includes an integrally formed stiffening web extending transversely from said upper body portion downwardly to intersect the lower curved portion of said G-shaped body, thereby to provide a support and positioning member for said body on both the compressed and normal positions of said body, and web defining of said upper body portion.

17. The pavement marker set forth in claim 15, wherein said elastomeric body is neoprene and has a hardness in the range of 50 to 60 durometers, Shore A.

* * * * *

UNITED STATES PATENT AND TRADEMARK OFFICE

CERTIFICATE OF CORRECTION

PATENT NO. : 4,659,248

DATED : April 21, 1987

INVENTOR(S) : Robert M. Flanagan

It is certified that error appears in the above—identified patent and that said Letters Patent is hereby corrected as shown below:

On the title page

In the Abstract:

Line 9, (fourth sentence), change "a" to read --to--.

In the Specification:

Col. 3, line 51, change "reflective" to --retroreflector--.

Col. 4, line 29, change "lot" to --slot--.

Col. 5, line 49, change "cauase" to --cause--.

UNITED STATES PATENT AND TRADEMARK OFFICE

CERTIFICATE OF CORRECTION

PATENT NO. : 4,659,248

DATED : April 21, 1987

INVENTOR(S) : Robert M. Flanagan

It is certified that error appears in the above—identified patent and that said Letters Patent is hereby corrected as shown below:

In the Specification:

Col. 1, line 56, change "nonsnowable" to --non-snowplowable--.

Col. 2, line 11, delete "is" (second occurrence).

line 67, change "potion" to --portion--.

line 68, change "og a gewnerally" to --of a generally--.

Col. 3, line 4, after "retroreflective" insert --lens--.

Col. 4, line 18, change "corresponding" to --correspondingly--.

line 54, change "delecterious " to --deleterious--.

Col. 6, line 45, change "modification" to --modifications--.

UNITED STATES PATENT AND TRADEMARK OFFICE

CERTIFICATE OF CORRECTION

PATENT NO. : 4,659,248

DATED : April 21, 1987

INVENTOR(S) : Robert M. Flanagan

It is certified that error appears in the above—identified patent and that said Letters Patent is hereby corrected as shown below:

In the Claims:

Col. 9, line 17, change "market" to --marker--.

line 30, change "market" to --marker--.

line 35, change "market" to --marker--.

Signed and Sealed this

Twenty-sixth Day of April, 1988

*Attest:*

*Attesting Officer*

DONALD J. QUIGG

*Commissioner of Patents and Trademarks*